US009071009B2

(12) United States Patent
Ardisana et al.

(10) Patent No.: US 9,071,009 B2
(45) Date of Patent: Jun. 30, 2015

(54) STRAIN RELIEF MEMBERS FOR CABLES AND METHODS FOR MAKING THE SAME

(75) Inventors: John B. Ardisana, San Francisco, CA (US); Edward Sihaan, San Francisco, CA (US); Eric Jol, San Jose, CA (US)

(73) Assignee: APPLE INC., Cupertino, CA (US)

( * ) Notice: Subject to any disclaimer, the term of this patent is extended or adjusted under 35 U.S.C. 154(b) by 444 days.

(21) Appl. No.: 13/246,048

(22) Filed: Sep. 27, 2011

(65) Prior Publication Data

US 2012/0231653 A1 Sep. 13, 2012

Related U.S. Application Data

(60) Provisional application No. 61/450,591, filed on Mar. 8, 2011.

(51) Int. Cl.
*H01R 13/58* (2006.01)
*H01R 13/56* (2006.01)

(52) U.S. Cl.
CPC ..... *H01R 13/562* (2013.01); *Y10T 29/49174* (2015.01); *H01R 13/5845* (2013.01); *H01R 13/5812* (2013.01)

(58) Field of Classification Search
USPC ..... 439/449, 447, 125
See application file for complete search history.

(56) References Cited

U.S. PATENT DOCUMENTS

| | | | | | |
|---|---|---|---|---|---|
| 2,277,637 | A * | 3/1942 | Eby | 174/153 G |
| 2,386,000 | A * | 10/1945 | McQuiston | 439/447 |
| 2,952,730 | A * | 9/1960 | Simonds | 174/153 G |
| 3,056,852 | A * | 10/1962 | Sachs | 174/153 G |
| 3,689,866 | A * | 9/1972 | Kelly | 439/586 |
| 3,905,672 | A * | 9/1975 | Anhalt et al. | 439/281 |
| 4,653,825 | A * | 3/1987 | Olsson | 439/295 |
| 4,738,636 | A * | 4/1988 | Bolante | 439/462 |
| 4,963,104 | A * | 10/1990 | Dickie | 439/460 |
| 6,010,348 | A * | 1/2000 | Alden | 439/274 |
| 6,069,316 | A * | 5/2000 | Utke | 174/652 |
| 7,163,424 | B2 * | 1/2007 | Dancel et al. | 439/731 |
| 7,867,015 | B1 * | 1/2011 | Parker | 439/465 |
| 7,891,882 | B2 * | 2/2011 | Kuffel et al. | 385/60 |
| 2003/0199192 | A1 | 10/2003 | Caveney et al. | |
| 2006/0144611 | A1 | 7/2006 | Chiu | |

FOREIGN PATENT DOCUMENTS

| | | |
|---|---|---|
| CN | 1083165 C | 4/2002 |
| CN | 1695279 | 11/2005 |
| DE | 102005057266 | 6/2007 |
| EP | 0526324 | 2/1993 |
| EP | 1317026 | 6/2003 |
| WO | 94/24747 | 10/1994 |

* cited by examiner

*Primary Examiner* — Neil Abrams
*Assistant Examiner* — Travis Chambers
(74) *Attorney, Agent, or Firm* — Van Court & Aldridge LLP

(57) ABSTRACT

Aesthetically pleasing strain-relief members for cables and methods for making the same are disclosed. The strain-relief members are constructed to have one or more tuning members that provide selective strain relief for the cable. Each tuning member can vary the wall thickness of the strain relief member, and depending on several factors such as how many tuning members are present, their shape, and their positions within the strain-relief member, the strain-relief member can be specifically tailored to meet desired strain relief characteristics.

44 Claims, 5 Drawing Sheets

STRAIN RELIEF MEMBERS FOR CABLES AND METHODS FOR MAKING THE SAME

This application claims the benefit of U.S. Provisional Patent Application No. 61/450,591, filed Mar. 8, 2011, which is incorporated by reference in its entirety.

BACKGROUND OF THE INVENTION

Cables are commonly used with electronic devices such as computers, cellphones, and portable media devices. When cables are subject to repeated physical manipulations that exert bend and strain forces on the cable, the cable can eventually break or tear. Smaller diameter cables and cables used in connection with portable electronic devices are generally more susceptible to breakage because they are more frequently handled by being bent, pulled, tangled, or wrapped. Cable manufacturers have conventionally used strain-relief mechanisms to ease the stress burden on cables. However, many of these conventional strain-relief mechanisms are ineffective or are not aesthetically pleasing.

SUMMARY

Aesthetically pleasing strain-relief members for cables and methods for making the same are disclosed. The strain-relief members are constructed to have one or more tuning members that provide selective strain relief for the cable. Each tuning member can vary the wall thickness of the strain relief member, and depending on several factors such as how many tuning members are present, their shape, and their positions within the strain-relief member, the strain-relief member can be specifically tailored to meet desired strain relief characteristics.

BRIEF DESCRIPTION OF THE DRAWINGS

The above and other aspects and advantages of the invention will become more apparent upon consideration of the following detailed description, taken in conjunction with accompanying drawings, in which like reference characters refer to like parts throughout, and in which.

DETAILED DESCRIPTION OF THE DISCLOSURE

Figure 1:
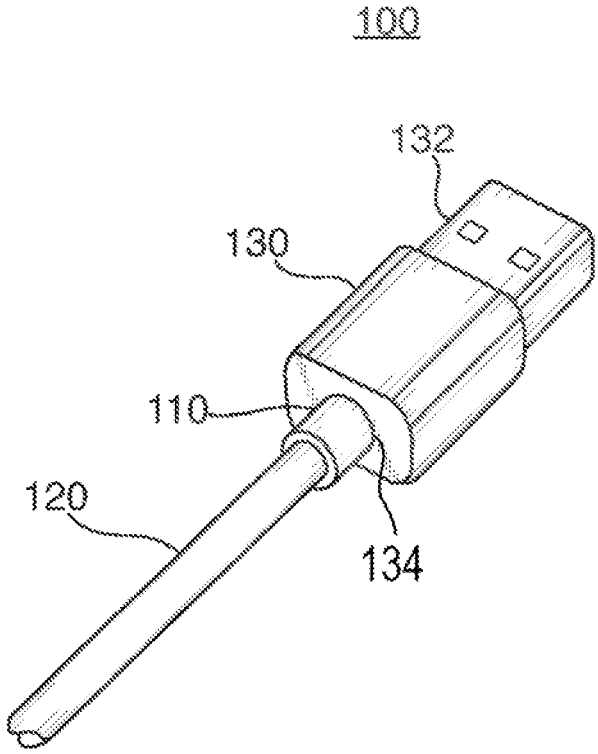
FIG. 1 is a perspective view of an illustrative cable assembly with strain relief according to an embodiment of the invention.

FIG. 1 is a perspective view of an illustrative cable assembly 100 according to an embodiment of the invention. Cable assembly 100 can include strain-relief member 110, cable 120, connector housing 130 and plug 132. In some embodiments, such as the one shown, a portion of member 110 can be integrated within housing 130. This portion (not shown) is referred to herein as a housing engagement member—see, for example, FIGS. 3A-B for illustrations of housing engagement member 312. This portion can be secured within housing 130 with an adhesive, thermal bond, or one or more mechanical clips.

In another embodiment, the housing engagement member of strain-relief member 110 may be coupled to the outer surface of the connector housing 130. Any suitable method for securing strain-relief member 110 may be employed. For example, strain-relief member 110 can be directly coupled to the outer surface of connector housing 130 with an adhesive or thermal bonding.

The strain-relief part of member 110, which is the portion shown extending through opening 134 away from housing 130, engages cable 120, which passes through member 110 into housing 130. The portion of cable 120 that engages strain-relief member 110 is provided with strain relief. Embodiments according to this invention provide strain relief tuned specifically to the type of cable 120 being used in cable assembly 100. For example, some cables may be better suited to have enhanced strain relief in the region of member 110 that abuts housing 130, whereas other cables may be better suited to have reduced strain relief in that same region. As another example, strain relief may be selectively tuned along the length of strain-relief member 110 based on, for example, the type of cable for which it is providing strain relief.

Strain-relief member 110 may be constructed from silicone, thermoplastic elastomer ("TPE"), polyurethane, or other suitable material. In addition, strain-relief member 110 is constructed to have an aesthetically pleasing outer shell that has a smooth and continuous shape. As shown, the outer shell has a smooth and uninterrupted cylindrical shape. In contrast, and by way of example, a non-smooth and discontinuous outer shell could have corrugations, ridges, or cutouts.

Connector housing 130 may provide protection for physical and electrical connections between cable 120 and plug 132 (e.g., solder connections). Connector housing 130 may be constructed from a resilient material (e.g., plastic or metal). Plug 132 may be any type of electrical connector (e.g., RCA, DVI, HDMI, HDCP, VGA, display port, USB, Mini USB, Micro USB, a power connector, a magnetic connector, a 30-pin connector, or any other standard or proprietary interface) operable to couple a cable (e.g., cable 120) to an electronic device.

Figure 2:
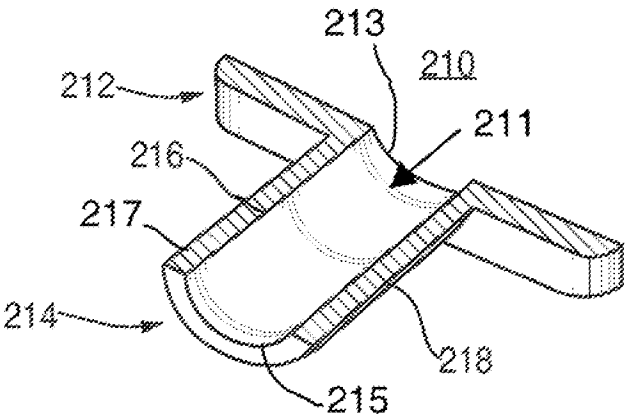
FIG. 2 (PRIOR ART)
FIG. 2 is a cross-sectional view of a conventional strain-relief member.

FIG. 2 is a cross-sectional perspective view of conventional strain-relief member 210. Strain-relief member 210 can include housing engagement member 212, strain-relief part 214, and wall 217, which has inner surface 216 and outer surface 218. Cable receiving passage 211 is operable to receive a cable (e.g., cable 120 of FIG. 1) and includes first end 213 and second end 215. The thickness of wall 217 is substantially constant along the length of part 214. The design of strain-relief member 210 results in uniform flex characteristics throughout, leading to the creation of a relatively high-stress point for any cable contained within cable receiving passage 211 at second end 215.

Figure 3A:
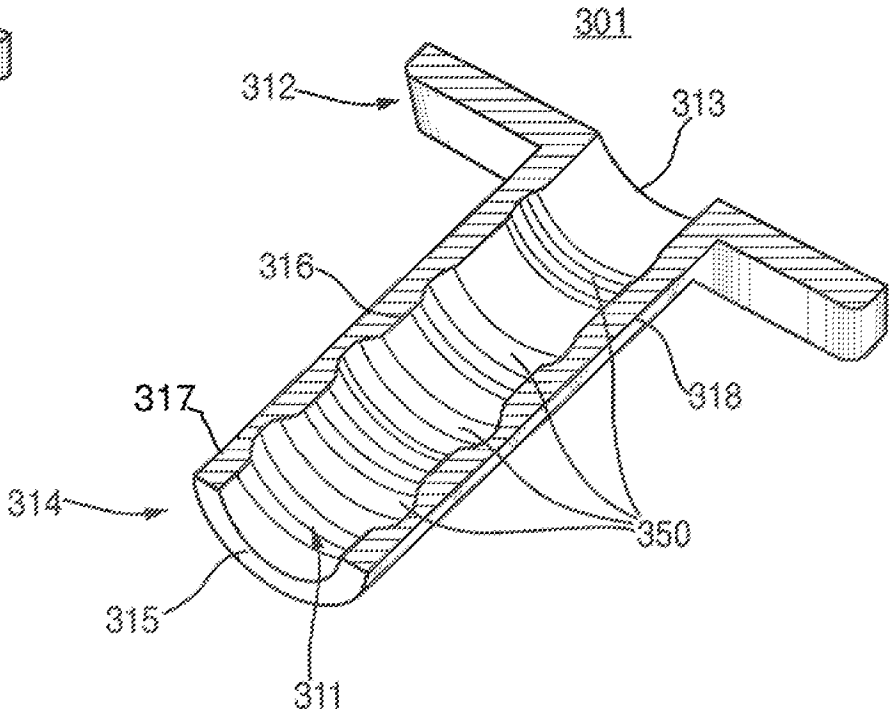
FIGS. 3A-B show cross-sectional views of different illustrative strain-relief members according to embodiments of the invention.
Figure 3B:
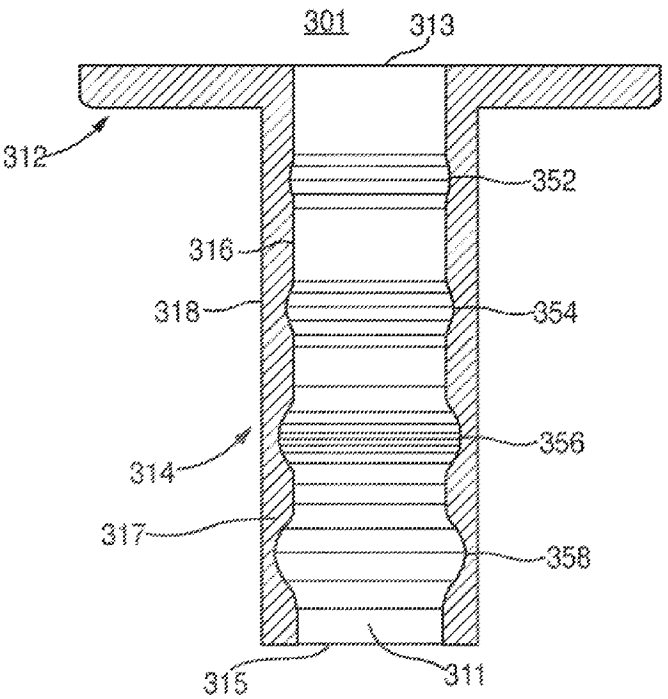

FIG. 3A is a cross-sectional perspective view of illustrative strain-relief member 301 according to an embodiment of the invention. Strain-relief member 301 includes housing engagement member 312, strain-relief part 314, and wall 317, which has inner surface 316 and outer surface 318. Cable receiving passage 311 is operable to receive a cable (e.g., cable 120 of FIG. 1) and includes first end 313 and second end 315. Strain-relief member 301 also includes one or more tuning members 350, each of which changes the contours/dimensions of inner surface 316 and the corresponding thickness of wall 317, thereby resulting in variable wall thickness along the length of part 314.

Tuning members 350 provide tunable flex and/or strain relief characteristics for strain-relief part 314. Any suitable number of factors can be employed to tune strain-relief part 314. For example, the number of tuning members 350 used in part 314 and the spacing between tuning members 350 can contribute to the tuning of part 314. In addition, the shape and size of each tuning member 314 can be constructed to achieve desired flex characteristics. For example, a tuning member can have a ring or doughnut shape in which the depth, width, and taper angle can be varied. As shown in FIG. 3A, a series of ring or doughnut shaped tuning members 350 provides a corrugated or undulating, accordion like cable receiving passage 311. As another example (not shown), the tuning members can have a shape that is more angular in nature than a ring or doughnut shape. For example, a trapezoidal or triangular shape may be used.

Flexibility increases with decreased wall thickness and decreases with increased wall thickness. Using this generalization as a design roadmap, it can be appreciated that strain-relief member 301 is tuned to be more flexible near end 315 than at end 313. The concentration of tuning members 350 are more concentrated near end 315, and as a result of this concentration, the thickness of wall 317 is thinner near end 315 than at end 313. This is illustrated more clearly in FIG. 3B, which shows a cross-sectional top view of strain-relief member 301.

Tuning members 350 are now specifically identified as tuning members 352, 354, 356 and 358. Strain-relief member 301 is designed to provide stiff support for a cable at end 313 (e.g., the portion of member 301 where a cable interfaces with a connector housing. Members 352, 354, 356, and 358 gradually increase in width and depth from tuning member 352 to tuning member 358, thereby allowing for increasingly more cable flex along the length of strain-relief part 314 as the cable approaches second end 315. With strain-relief member 301 tuned in this manner, the strain on the cable near second end 315 is substantially mitigated.

Depending on the dimensions and shape of tuning members used in a strain-relief member, all or a portion of the inner surface of wall 317 is in contact with the cable (not shown) in cable receiving passage 311. In some embodiments, the portions of wall 317 that do not have tuning members may fit flush against the cable. For example, the portion of cable receiving passage 311 at second end 315 may form a tight interference fit with the cable. The cable may be free floated within cable receiving passage 311 (i.e., not physically bonded to the inner surface of wall 317). In other embodiments, the cable can be bonded (by a thermal bond or an adhesive) to at least a portion of the inner surface of wall 317.

Figure 4:
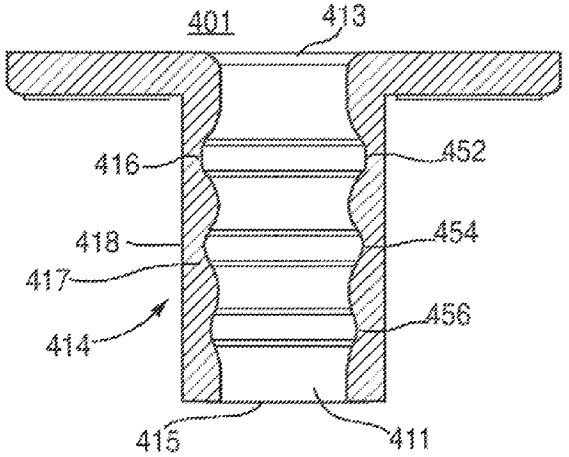
FIG. 4 is a cross-sectional top view of another strain-relief member according to an embodiment of the invention.

FIG. 4 is a cross-sectional top view of strain-relief member 401 according to an embodiment of the invention. Strain-relief member 401 has many of the same attributes of strain-relief member 301, and therefore similar features are similarly labeled, except instead of "3XX," the features are now labeled "4XX." Member 401 includes cable receiving passage 411 and wall 417, which has outer surface 418 and inner surface 416. Strain-relief member 401 differs from strain-relief member 301 in that strain-relief part 414 has a shorter a length. In addition, tuning members 452, 454 and 456 are designed so member 401 has more flex near end 413 than at end 415.

Figure 5:
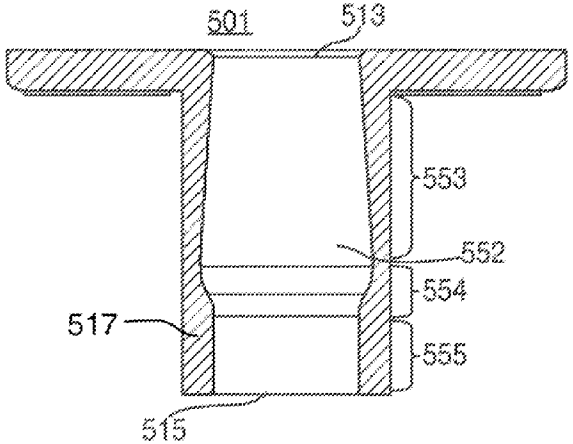
FIG. 5 is a cross-sectional top view of yet another strain-relief member according to an embodiment of the invention.

FIG. 5 is a cross-sectional top view of strain-relief member 501 according to an embodiment of the invention. Strain-relief member 501 includes lone tuning member 552. Tuning member 552 can include tapered portion 553 and necked portion 554, which provides a step change in wall thickness of wall 517, and non-tapered portion 555. Tapered portion 553 can gradually decrease wall thickness from first end 513 as it extends towards necked portion 554. At necked portion 554, the wall thickness changes to accommodate the wall thickness of non-tapered portion 555. If desired, non-tapered portion 555 can be designed to taper.

Figure 6:
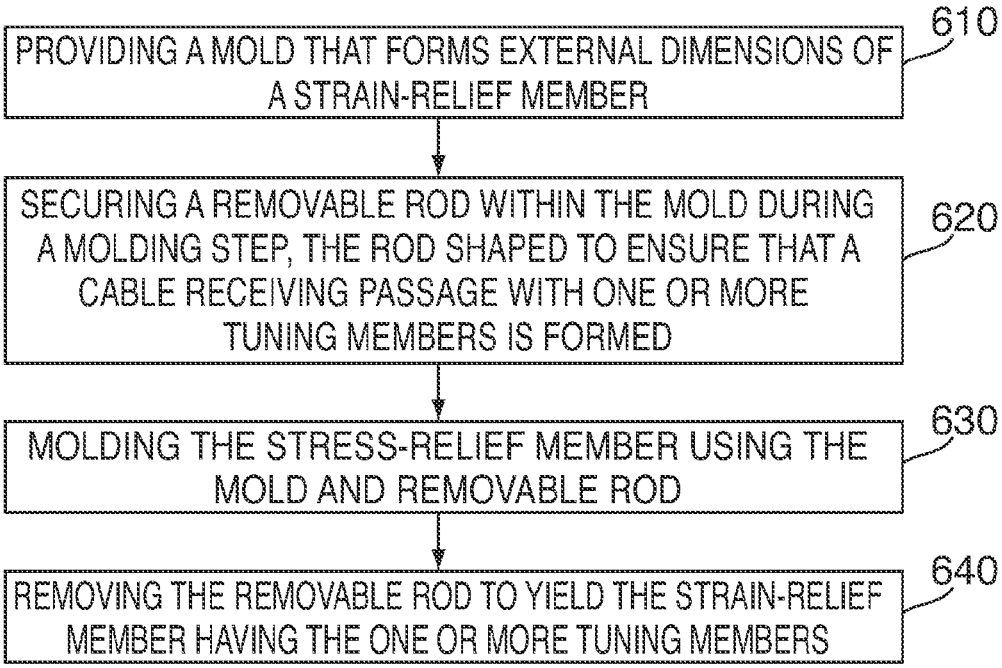
FIG. 6 is an illustrative flow chart for manufacturing a strain-relief member according to an embodiment of the invention.

FIG. 6 is an illustrative flow chart for manufacturing a strain-relief member according to an embodiment of the invention. Beginning at step 610, a mold is provided that forms the external dimensions of a strain-relief member. For example, the mold can form the outer dimensions of the housing engagement member and strain relief part. At step 620, a removable rod is positioned within the mold and held in place during a molding step. The rod is shaped to ensure the cable receiving passage (e.g., passage 311 of FIG. 3A) with one or more appropriately sized and shaped tuning members is formed.

At step 630, the stress-relief member is molded using the mold and removable rod. In one embodiment, a compression mold may be used to mold the stress-relief member. Compression molds may be made using any number of different techniques. In one approach, silicon sheets can be molded around the rod. In another approach, a combination of urethane sheets and foam can form the stress-relief member. In another embodiment, an injection mold process may be used to mold the stress-relief member. At step 640, the removable rod is removed to yield a strain-relief member having one or more tuning members according to an embodiment of the invention.

Figure 7:
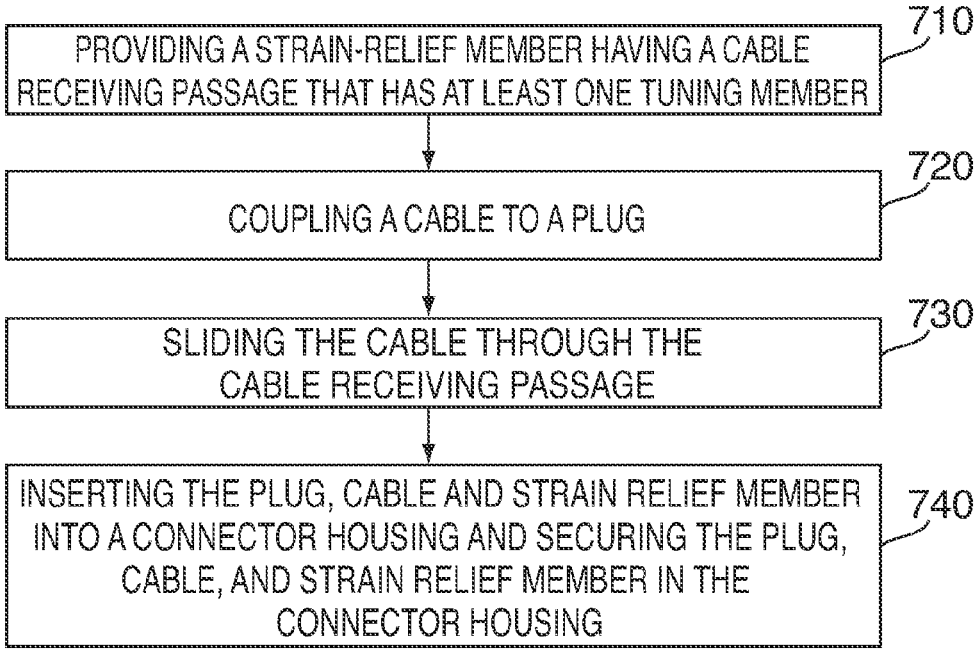
FIG. 7 is a flow chart of a method for manufacturing a cable assembly with a strain-relief member according to an embodiment of the invention.

FIG. 7 is an illustrative flow chart for manufacturing a cable assembly having a strain-relief member according to an embodiment of the invention. At step 710, a strain-relief member (e.g., strain-relief member 110 of FIG. 1) is provided. Next, at step 720, a cable (e.g., cable 120) can be electrically coupled to a plug (e.g., plug 132). Electrical coupling between the cable and plug can include, for example, solder connections between individual wires in the cable and electrically conductive contacts on the plug.

At step 730, the cable is slid through a cable receiving passage (e.g., cable receiving passage 311 of FIG. 3) of the strain-relief member. The strain-relief member may be oriented such that the strain-relief part will pass through an opening of a connector housing when inserted into the connector housing. At step 740, the plug, cable, and strain relief member are inserted into a connector housing and permanently attached thereto. A housing engagement member of the strain-relief member may be secured to the connector housing any suitable method.

It is understood that the various features, elements, or processes of the foregoing figures and description are interchangeable or combinable to realize or practice the invention described herein. Those skilled in the art will appreciate that the invention can be practiced by other than the described embodiments, which are presented for purposes of illustration rather than of limitation, and the invention is limited only by the claims, which follow.

What is claimed is:

1. A cable strain-relief member comprising:

a housing engagement member; and a strain-relief part that extends away from the housing engagement member, the strain-relief part comprising:

an outer surface that defines an outer dimension of the strain-relief part, wherein the outer surface comprises a smooth and continuous shape;

a cable receiving passage extending from a first end of the strain-relief part that is away from the housing engagement member to a second end of the strain-relief part that is proximate to the housing engagement member; and an inner wall defining dimensions of the cable receiving passage, the inner wall comprising at least one tuning member that defines a flex characteristic of the strain-relief part, wherein:

the at least one tuning member comprises a plurality of tuning members;

the plurality of tuning members comprises:

a first tuning member proximate the first end of the strain-relief part;

a second tuning member proximate the second end of the strain-relief part; and a third tuning member between the first tuning member and the second tuning member;

at least one of the width and the depth of the third tuning member is greater than at least one of the width and the depth of the second tuning member; and at least one of the width and the depth of the first tuning member is greater than at least one of the width and the depth of the third tuning member.

2. The strain-relief member of claim 1, wherein the housing engagement member and strain-relief part comprise an integrated structure.

3. The strain-relief member of claim 1, wherein the outer surface resembles a cylindrical body.

4. The strain-relief member of claim 1, wherein the at least one tuning member is operative to selectively provide strain relief for the portion of the strain-relief part at which the at least one tuning member resides.

5. The strain-relief member of claim 1, wherein each of the tuning members has different dimensions.

6. The strain-relief member of claim 1, wherein the tuning members are positioned and dimensioned to provide more strain relief at the first end than at the second end.

7. The strain-relief member of claim 1, wherein the at least one tuning member comprises at least one of a ring shape and a doughnut shape.

8. The strain-relief member of claim 1, wherein the at least one tuning member comprises a taper region, a neck region and a non-taper region.

9. The strain-relief member of claim 1, wherein the strain-relief member is constructed from silicone.

10. The strain-relief member of claim 1, wherein the smooth and continuous shape comprises an uninterrupted cylindrical shape.

11. A method for making a cable assembly, the method comprising:

providing the cable strain-relief member of claim 1;

coupling a cable to a plug;

sliding the cable through the cable receiving passage of the cable strain-relief member; and inserting the plug, the cable, and the housing engagement member of the cable strain-relief member into a connector housing; and securing the plug, the cable, and the housing engagement member of the cable strain-relief member in the connector housing.

12. The strain-relief member of claim 1, wherein a predetermined amount of space exists between each of the tuning members along the length of the strain-relief part between the first end of the strain-relief part and the second end of the strain-relief part.

13. The strain-relief member of claim 12, wherein the predetermined amount of space between each tuning member is the same.

14. The strain-relief member of claim 12, wherein the predetermined amount of space between each tuning member is different.

15. A cable assembly comprising:

a plug;

a connector housing coupled to the plug; the strain-relief member of claim 1, wherein the housing engagement member of the strain-relief member is coupled to the connector housing; and a cable coupled to the connector housing, the strain-relief member, and the plug, wherein the cable passes through the cable receiving passage of the of the strain-relief member.

16. The cable assembly of claim 15, wherein the strain-relief member provides selective strain relief to the cable.

17. The cable assembly of claim 15, wherein the housing engagement member of the strain-relief member is coupled to the connector housing with an adhesive.

18. The cable assembly of claim 15, wherein the housing engagement member of the strain-relief member is encased inside the connector housing.

19. The cable assembly of claim 15, wherein the strain-relief part of the strain-relief member and the connector housing comprises an opening, and wherein the strain-relief part of the strain-relief member extends away from the connector housing through the opening.

20. A method for making the strain-relief part of the cable strain-relief member of claim 1, the method comprising:

providing a mold that forms the outer dimension of the strain-relief part;

securing a removable rod within the mold during a molding step, the rod shaped to ensure the cable receiving passage of the strain-relief part of the cable strain-relief member is formed;

molding the strain-relief part of the cable strain-relief member using the mold and the removable rod; and removing the removable rod to yield the strain-relief part of the cable strain-relief member.

21. The method of claim 20, wherein the molding the strain-relief part of the cable strain-relief member comprises compression molding the strain-relief part.

22. The method of claim 20, wherein the molding the strain-relief part of the cable strain-relief member comprises injection molding the strain-relief part.

23. A cable strain-relief part comprising:

a wall, wherein:

an outer wall surface of the wall comprises a smooth and continuous shape;

an inner wall surface of the wall defines a cable receiving passage extending along a length of the wall from a first end of the wall to a second end of the wall; and the inner wall surface comprises at least three tuning members that vary a flex characteristic of the strain-relief part along the length of the wall, wherein the amount of space between a first set of adjacent tuning members of the at least three tuning members is different than the amount of space between a second set of adjacent tuning members of the at least three tuning members.

24. The cable strain-relief part of claim 23, wherein a first tuning member of the at least three tuning members has different dimensions than a second tuning member of the at least three tuning members.

25. A method for making a cable assembly, the method comprising:

providing the cable strain-relief part of claim 23;

coupling a cable to a plug;

sliding the cable through the cable receiving passage of the cable strain-relief part; and inserting the plug, the cable, and a portion of the cable strain-relief part into a connector housing; and securing the plug, the cable, and the portion of the cable strain-relief part in the connector housing.

26. A cable assembly comprising:

a plug;

a connector housing coupled to the plug;

the cable strain-relief part of claim 23 coupled to the connector housing; and a cable coupled to the connector housing, the cable strain-relief part, and the plug, wherein the cable passes through the cable receiving passage of the of the cable strain-relief part.

27. The cable assembly of claim 26, wherein the cable strain-relief part provides selective strain relief to the cable.

28. The cable assembly of claim 26, wherein the cable strain-relief part is coupled to the connector housing with an adhesive.

29. The cable assembly of claim 26, wherein a portion of the cable strain-relief part is encased inside the connector housing.

30. The cable assembly of claim 26, wherein the connector housing comprises an opening, and wherein another portion of the cable strain-relief part extends away from the connector housing through the opening.

31. A method for making the cable strain-relief part of claim 23, the method comprising:

providing a mold that forms the outer wall surface of the cable strain-relief part;

securing a removable rod within the mold during a molding step, the rod shaped to ensure the cable receiving passage of the cable strain-relief part is formed;

molding the cable strain-relief part using the mold and the removable rod; and removing the removable rod to yield the cable strain-relief part.

32. The method of claim 31, wherein the molding the cable strain-relief part comprises compression molding the cable strain-relief part.

33. The method of claim 31, wherein the molding the cable strain-relief part comprises injection molding the cable strain-relief part.

34. A cable strain-relief comprising:

a wall extending between a first wall end and a second wall end, the wall comprising:

an outer wall surface that comprises an uninterrupted cylindrical shape; and an inner wall surface that defines a cable receiving passage, wherein the inner wall surface comprises at least three tuning members that change a flex characteristic of the cable strain-relief along the length of the wall, and wherein at least one of the following is true:

the amount of space between a first set of adjacent tuning members of the at least three tuning members is different than the amount of space between a second set of adjacent tuning members of the at least three tuning members; and a first tuning member of the at least three tuning members has different dimensions than a second tuning member of the at least three tuning members.

35. The cable strain-relief of claim 34, wherein:

the concentration of the at least three tuning members is more concentrated near the first wall end than the second wall end.

36. A method for making a cable assembly, the method comprising:

providing the cable strain-relief of claim 34;

coupling a cable to a plug;

sliding the cable through the cable receiving passage of the cable strain-relief; and inserting the plug, the cable, and a portion of the cable strain-relief into a connector housing; and securing the plug, the cable, and the portion of the cable strain-relief in the connector housing.

37. A cable assembly comprising:

a plug;

a connector housing coupled to the plug;

the cable strain-relief of claim 34 coupled to the connector housing; and a cable coupled to the connector housing, the cable strain-relief, and the plug, wherein the cable passes through the cable receiving passage of the of the cable strain-relief.

38. The cable assembly of claim 37, wherein the cable strain-relief provides selective strain relief to the cable.

39. The cable assembly of claim 37, wherein the cable strain-relief is coupled to the connector housing with an adhesive.

40. The cable assembly of claim 37, wherein a portion of the cable strain-relief is encased inside the connector housing.

41. The cable assembly of claim 37, wherein the connector housing comprises an opening, and wherein another portion of the cable strain-relief extends away from the connector housing through the opening.

42. A method for making the cable strain-relief of claim 34, the method comprising:

providing a mold that forms the outer wall surface of the cable strain-relief;

securing a removable rod within the mold during a molding step, the rod shaped to ensure the cable receiving passage of the cable strain-relief is formed;

molding the cable strain-relief using the mold and the removable rod; and removing the removable rod to yield the cable strain-relief.

43. The method of claim 42, wherein the molding the cable strain-relief comprises compression molding the cable strain-relief.

44. The method of claim 42, wherein the molding the cable strain-relief comprises injection molding the cable strain-relief.

* * * * *